United States Patent [19]

McReynolds et al.

[11] 4,122,994

[45] Oct. 31, 1978

[54] METHOD AND MEANS FOR DETERMINING OPTIMUM AVERAGE CYCLE LENGTHS

[75] Inventors: Marshall B. McReynolds; Jack D. VanTilbury, both of Arlington, Va.

[73] Assignee: Traffic Engineers Supply Corporation (TESCO), Alexandria, Va.

[21] Appl. No.: 734,125

[22] Filed: Oct. 20, 1976

[51] Int. Cl.[2] ..... G06C 3/00

[52] U.S. Cl. ..... 235/89 R; 235/61 B

[58] Field of Search ..... 235/89 R, 61 B, 83, 235/84

[56] References Cited

U.S. PATENT DOCUMENTS

| | | | |
|---|---|---|---|
| 1,937,831 | 12/1933 | McCollum | 235/61 B |
| 2,179,531 | 11/1939 | Trapnell | 235/89 R |
| 2,487,590 | 11/1949 | Rehill | 235/89 R |
| 2,512,387 | 6/1950 | Sands | 235/89 R |
| 2,574,257 | 11/1951 | Franklin | 235/61 B |
| 3,577,854 | 5/1971 | Felix | 235/89 R |

*Primary Examiner*—Stephen J. Tomsky
*Attorney, Agent, or Firm*—Bacon & Thomas

[57] ABSTRACT

A method and computational aid for determining the optimum cycle lengths for use in a vehicular traffic control system wherein inbound and outbound traffic flow are equally favored. The method employs the technique of determining optimum cycle lengths by utilizing harmonic relationships found to exist between the time separations of the controlled arterial intersections and other key traffic control parameters. The method may be practiced by means of a highly simplified graphical computational aid which provides a clear visual indication of candidate optimum cycle lengths for a particular group of intersections which requires only prior knowledge of intersection relative locations. The unique format of the graphical computational aid provides, in addition to the candidate optimum cycle length information, a visual indication of the quality of the candidate solution obtained for each of the controlled intersections of the group.

5 Claims, 4 Drawing Figures

TIME-PLOT
10
20
NOMOGRAPH
TRAVEL TIME (SECONDS)
CYCLE RESOLUTION ALTERNATE CENTERS (SECONDS)
SPEED (MPH)
CYCLE LENGTH (SECONDS)
26T
28T
28B
24B
14
12
22
50
52
54
56
58
60
62

METHOD AND MEANS FOR DETERMINING OPTIMUM AVERAGE CYCLE LENGTHS

BACKGROUND OF THE INVENTION

1. Field of the Invention

The present invention relates to a method and means for determining optimum cycle lengths in a vehicular traffic control system. More particularly, the invention relates to a technique for determining the optimum cycle length for any distribution of controlled intersections along an artery when the artery is carrying bi-directional traffic and neither direction is receiving priority treatment.

2. Description of the Prior Art

The art of vehicle traffic control has received a great deal of attention over the years in attempts to keep pace with the ever increasing flow of traffic. While the early traffic control systems were entirely adequate for their purposes, and continue to be more or less suitable for low density traffic conditions, many of these early systems are unsuitable for use in high density or highly variable traffic conditions, both of which are characteristic of present day urban traffic. The mere increase in traffic volume in urban areas mandates that increasingly astute traffic mangagement techniques and apparatus be employed. Even today the volume, hence the problem, continues to grow. It is not uncommon to encounter traffic control situations in highly congested areas wherein the existing controlling apparatus is at best only nominally effective. Thus, stratagems for optimizing traffic flow, and particularly those which exploit the capabilities of equipment already installed, are of particular benefit to the traffic management community, and of course to the motoring public.

SUMMARY OF THE INVENTION

Therefore, the primary object of the present invention is to provide an improved method and means for determining optimum average cycle lengths in arterial traffic control systems. Cycle length may be defined as the shortest basic interval which comprises one complete, nonrepetitive, pattern of traffic signal actuations encompassing: one green interval, one amber interval, and one red interval. A notion basic to the concept embodied in the present invention is the observed fact that when certain parameters of the traffic control problem are made to relate harmonically to each other, optimum bi-directional traffic (alternately referred to hereinafter as average traffic) flow can be achieved. Thus, in the situation where neither inbound nor outbound traffic flow is being favored along a controlled arterial system, it is advantageous to select cycle lengths which satisfy the equation - Cycle Length/2 $= S_i/n$; where $n$ is an integer and $S_i$ is the separation time in seconds (travel time) at a constant speed of a particular controlled intersection from a predetermined reference point.

A preferred means for carrying out the method comprises a basic time plot diagram in combination with a transparent overlay such that a simple graphical process is all that is required to determine candidate cycle lengths. The apparatus is particularly suitable for use in the field and can be quickly mastered by operating personnel without the need for complex computations.

It is an object of this invention to provide a method and a means for determining the optimum average cycle lengths for an arterial traffic control system wherein the computational process may be carried out by straightforward and extremely simple graphical means, and the quality of the candidate cycle length can be known before being implemented by the traffic control apparatus.

It is a further object of the present invention to provide means for graphically determining proposed cycle lengths by field operating personnel with a minimum of experimentation and/or complex calculations.

It is still a further object of the present invention to provide a means for accurately determining optimum cycle lengths for average traffic flow, and other key parameters for use in optimizing traffic flow which is readily portable, has a wide range of operating parameters, and may be inexpensively and widely disseminated.

BRIEF DESCRIPTION OF THE DRAWINGS

Additional objects and advantages of the invention will become apparent to those skilled in the art as the description proceeds with reference to the accompanying drawings wherein.

DETAILED DESCRIPTION OF THE PREFERRED EMBODIMENT

Figure 1:
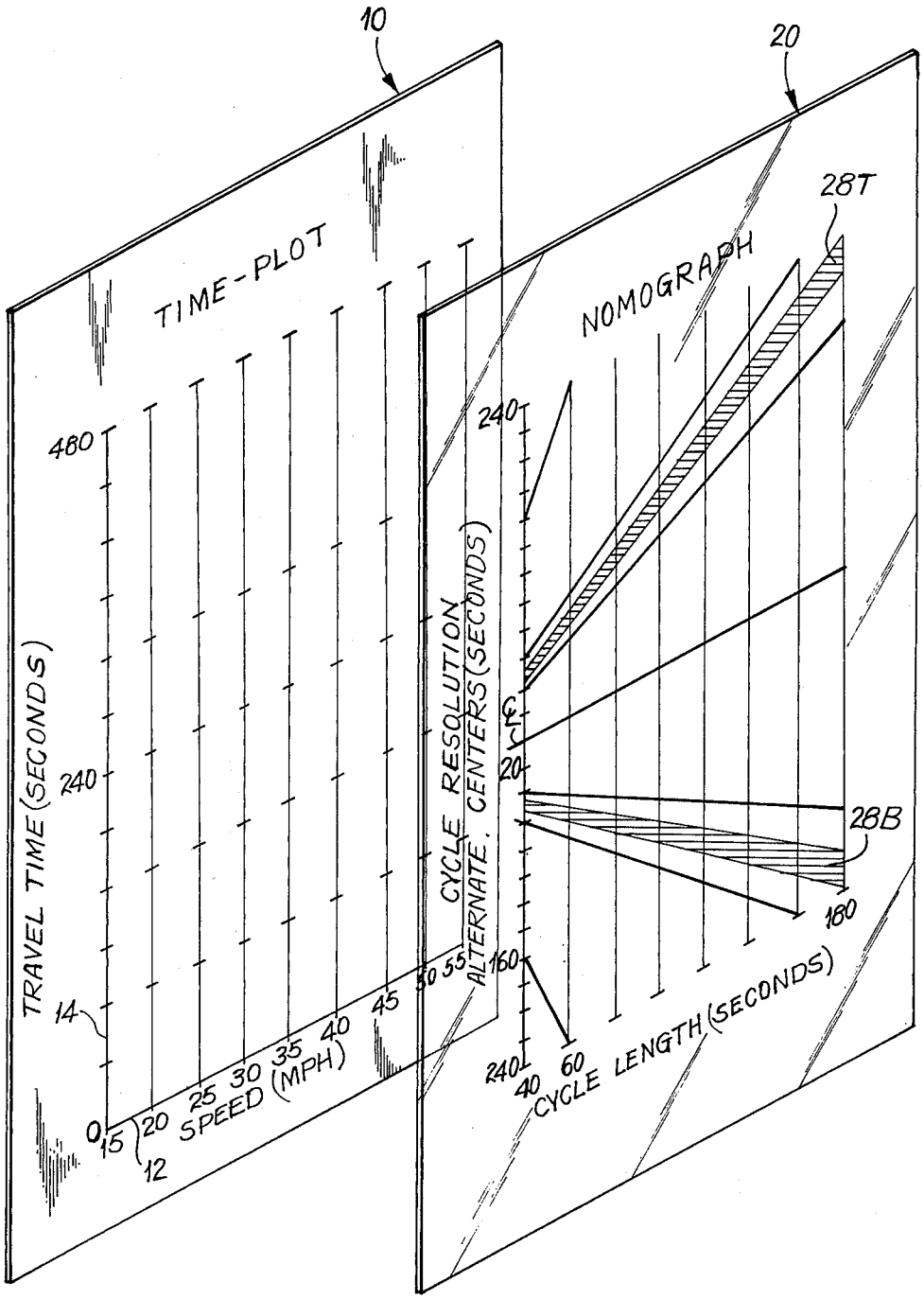
FIG. 1 is a perspective view of the graphical computation aid according to the present invention.

Referring first to FIG. 1, there is shown a perspective drawing of the two part graphical computational aid according to the present invention. A time plot element 10 has placed upon it indicia representative of selected parameters of the traffic control problem. A transparent overlay element 20 is shown as having upon it indicia also representative of selected traffic control parameters such that in use the time plot 10 and the overlay 20 cooperate to provide the required solutions. The time plot 10 and overlay 20 are shown as two separate planar surfaces as an illustrative embodiment only. Obviously, other configurations such as special purpose slide rules, tables of compilations, and mechanically articulated shapes and the like may also be employed to implement the problem parameters and solutions.

Figure 2:
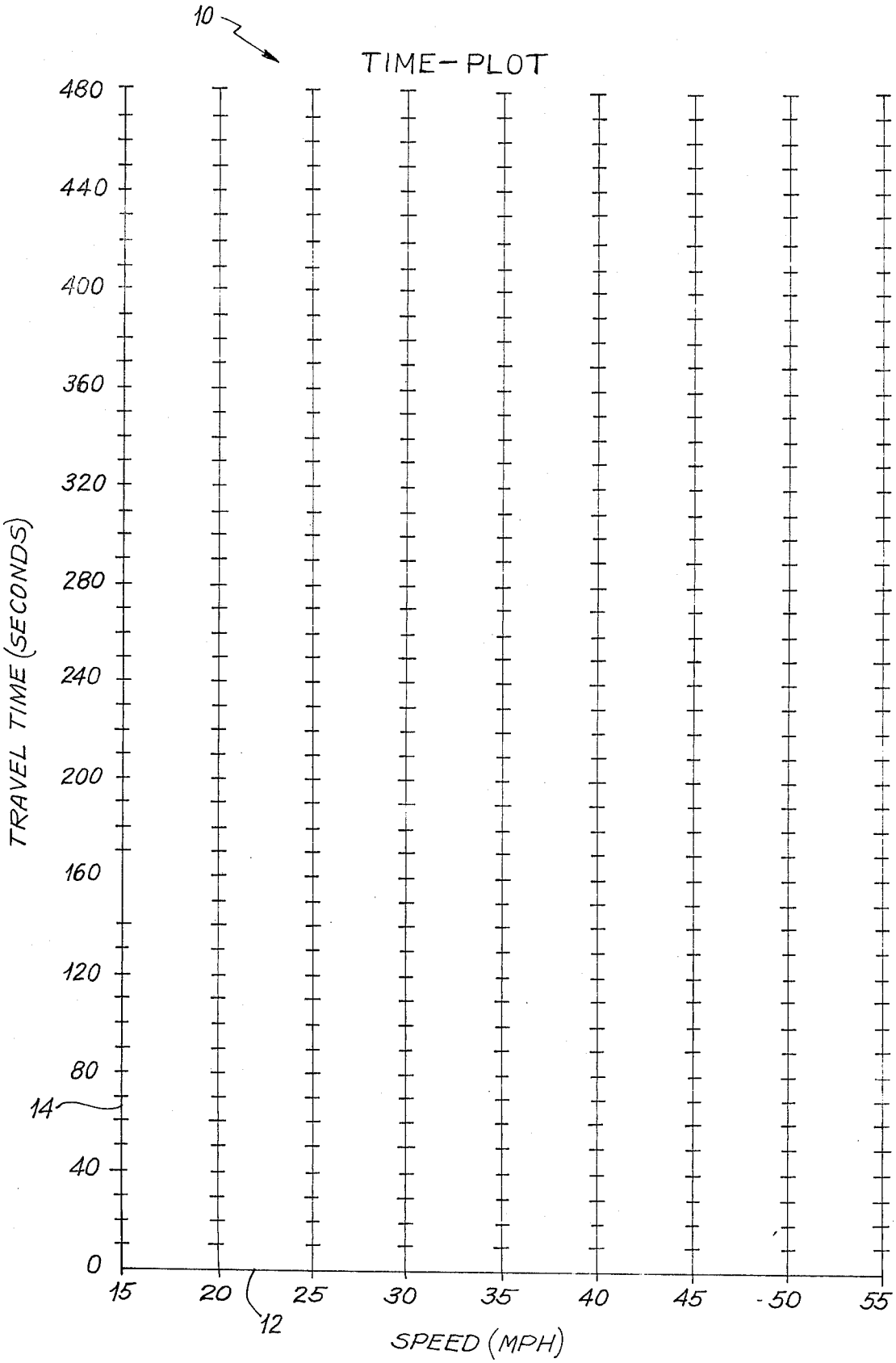
FIG. 2 is a time-plot showing travel time versus arterial speed, comprising one part of the computational aid.

Referring now to FIG. 2, there is shown the indicia of time plot 10 consisting of a rectangular grid system with parameters and scale factors arranged along the horizontal and vertical axes. Specifically, a range of speeds in miles per hour is linearly arrayed along a horizontal axis 12, and a range of travel time in seconds is linearly arrayed along a vertical axis 14. The horizontal axis 12 depicts a range of speeds from 15 to 55 miles per hour (hereinafter mph), in increments of 5 mph. As applied to the traffic control problem, these speeds relate to the desired vehicular traffic speed along the controlled arterial which has the aforementioned controlled intersections distributed along it. As is well known in the traffic control art, optimum traffic flow is achieved when the vehicular traffic is caused to flow in platoons and a primary objective of the timing of the traffic lights on an arterial is to allow the individual platoons to progress at a predetermined constant speed. Ideally, any single platoon of traffic will proceed through the entire controlled arterial without being stopped for cross traffic at any controlled intersection. Therefore, a key parameter in the traffic control problem is the selection of a desired traffic speed in mph which allows this idealized traffic flow to be achieved. In practice, however, speed in mph is often dictated by artery location, safety factors or public laws and in using the computational aid disclosed, one enters the problem with a preselected, or a desired arterial speed. In the illustrative example to be discussed hereinbelow, an arterial speed of 25 mph will be chosen.

The vertical axis 14 depicts a range of travel times from 0 to 480 seconds, with numerical indicia indicating major subintervals in increments of 40 seconds. Minor sub-intervals, in increments of 10 seconds, are shown as short horizontal lines which for convenience are repeated on each of the vertical lines positioned at the 5 mph intervals. As applied to the traffic control problem, travel time in seconds is used to represent separation between controlled intersections at a particular predetermined speed. Therefore the vertical axis 14, whose maximum travel time is shown illustratively as 480 seconds, represents separations in time from a preselected reference point with a maximum range of 8 minutes. Obviously, the time plot being linear, the travel time indicia along the vertical axis 14 may be extended indefinitely to encompass a traffic control problem of any reasonable duration. To illustrate the use of the travel time parameter, consider a vehicle travelling throughout the controlled arterial at a constant speed of 25 mph. The distance covered from some zero reference position in the 480 seconds would be 3.3 statute miles. In 240 seconds, the distance covered at 25 mph would be 1.66 miles. Thus, it would appear that in lieu of travel time in seconds, one could arrange the vertical axis 14 to read out in distance travelled at a particular speed. (Some of the early attempts at mathematical solutions to the control problem used this approach.) However, the strength of the present computational method is due in large part to the choice of travel time in seconds as the vertical variable of the time-plot 10, which allows the highly simplified solutions to be achieved as will be described in detail hereinbelow.

Figure 3:
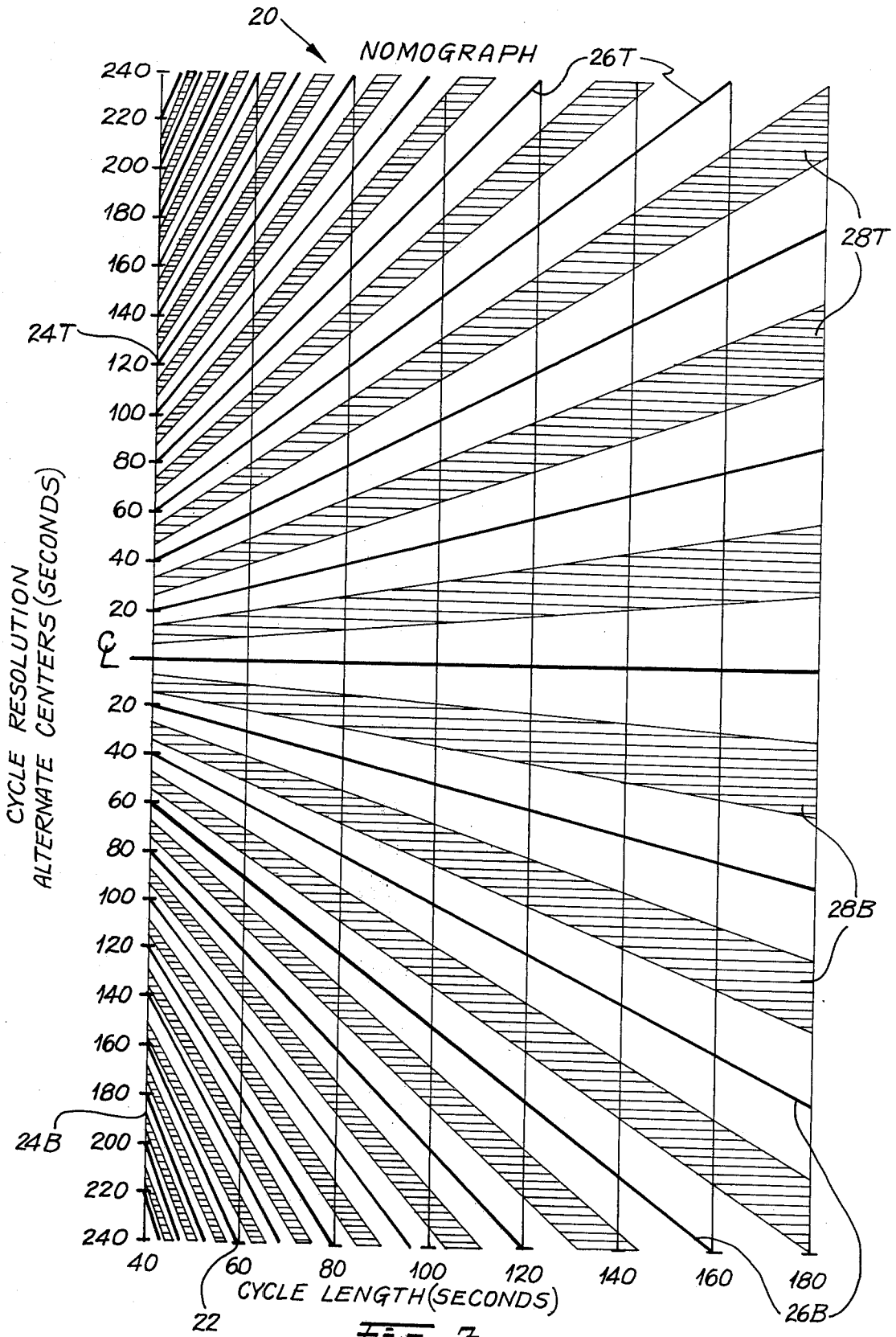
FIG. 3 is an overlay showing cycle resolutions versus cycle lengths, which in combination with FIG. 2, comprises the computational aid.

Referring now to FIG. 3, there is shown a detailed representation of the indicia of overlay element 20. A pair of identical data fields are mirror-image-arrayed on the top and bottom portions around a horizontal centerline axis market CL. Specifically, a range of cycle lengths in seconds is linearly arrayed along a horizontal axis 22, and a range of cycle resolution alternate centers in seconds is linearly arrayed along each of the two halfs of a vertical axis shown as a bottom portion 24B and a top portion 24T. The values of cycle lengths arrayed along the horizontal axis 22 includes a range 40 to 180 seconds with major subdivisions indicated in 20 second increments. In actual use, the desired solution to the traffic control problem, namely a candidate optimum cycle length, will be read from the horizontal axis 22, alternately referred to as the cycle length axis. Referring to the top portion of FIG. 3, the region above the horizontal line CL and to the right of the vertical axis 24T, there is seen a plurality of diverging lines 26T, and a plurality of ray-shaped shaded areas 28T. The diverging lines 26T represent a parameter termed cycle resolutions and are shown as intersecting the vertical axis 24T at locations corresponding to 20 second increments, the major subdivisions of the full range of zero to 240 seconds arrayed along the axis 24T. The particular slopes of the diverging lines 26T are dictated by the scale factors of the graphical computation aid. The diverging lines 26T (and of course, their mirror-image counterparts 26B), when superimposed upon the time-plot 10, represent the centers of the green band, a term well known in the traffic control art; and for a particular predetermined arterial speed they enable candidate cycle lengths to be evaluated. Briefly, green band may be defined as the available green time during which a platoon of vehicles, travelling at a predetermined speed, may flow through all of a series of traffic signals without encountering a red or amber indication.

It should be noted that the particular range of scale factors on the overlay element 20, as with those on the time-plot 10, have been chosen to encompass representative traffic control situations. Coordinated extensions or contractions of the scale factors along any of the axes may obviously be made to accomodate a range of realistic traffic control situations. Also, while the overlay element 20 has been illustratively shown as having top and bottom portions (mirror image twins), either portion by itself in conjunction with time-plot 10 is sufficient to practice the present invention. In use, the personal preference of the user will generally determine which portion(s) of the overlay element 20 shown will be utilized.

Figure 4:
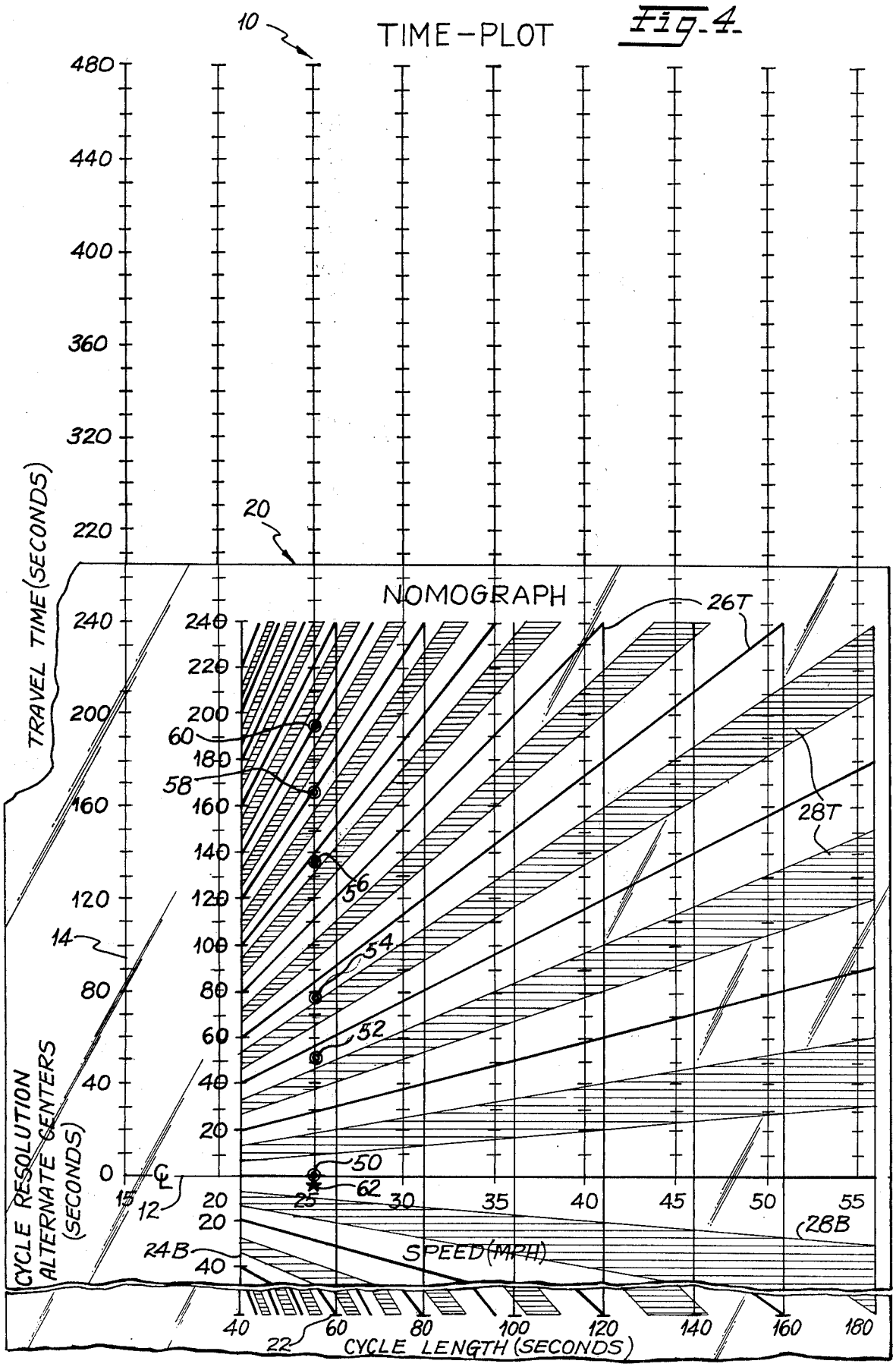
FIG. 4 is a view of a combined time-plot and overlay showing an actual traffic control problem and the resulting solution.

Referring now to FIG. 4, there is shown a composite representation wherein the overlay element 20 has been superimposed on the time-plot 10 such that a specific traffic control problem is shown producing a near optimum solution. A plurality of controlled intersections 50, 52, 54, 56, 58 and 60 are shown plotted along the 25 mph line of time-plot 10. The controlled intersections 50, 52, 54, 56, 58 and 60 are separated by travel times, in seconds. Intersection 50 has been selected as the reference intersection and therefore represents zero travel time. Intersection 52 is plotted along the 25 mph line at a time corresponding to 48 seconds from intersection 50. In actual practice, the travel times for a particular controlled arterial may be derived simply by making a traverse of the entire artery at a predetermined constant speed and noting the travel times therealong. For the example chose, 25 mph has been selected as the desired arterial speed and therefore intersection 52 is separated in time from intersection 50 by the aforementioned 48 seconds when travelling at 25 mph. Similarly, intersection 54 is plotted at 78 seconds travel time; intersection 56 at slightly over 130 seconds travel time; intersection 58 at 162 seconds travel time; and the sixth and final intersection of the present example, intersection 60, is plotted at 192 seconds travel time. For ease of visualization, it may be assumed that the six intersections plotted along the 25 mph line of time-plot 10 represent a group of controlled intersections wherein the artery is running north-south and intersection 50 represents the southern terminus of the group, and intersection 60 represents the northern terminus of the group. The overlay element 20 is shown as having its centerline axis CL coincident with the horizontal axis 12 of time-plot 10. The overlay element 20 has been shifted in a left/right direction such that the controlled intersections 50, 52, 54, 56, 58 and 60 are free of the shaded areas 28T. Ideally, a perfect solution to the cycle length selection for the present case would be achieved if the plotted controlled intersections 50, 52, 54, 56, 58 and 60 could be made to be perfectly coincident with the cycle resolution lines 26T. Actually, in this example, while a perfect solution has not been achieved, a sensible optimum cycle length is shown as being approximately 54 seconds. This is indicated by the star indicator 62 which denotes a candidate cycle length as scaled along the cycle length axis 22. Briefly characterizing the quality of the solution illustrated in FIG. 4, it will be noted that the graphical distance of each of the controlled intersections 50–60 from the cycle resolution line 26T closest to it is the criteria to be used. Thus, it is seen that intersection 58 represents a near perfect condition whereas intersection 56 represents a somewhat poorer condition. However, the primary criteria for determining optimum average cycle lengths by the present method and graphical computational aid lies in selecting a candidate cycle length such that the maximum number of plotted controlled intersections 50, 52, 54, 58 and 60 fall closest to their respective cycle resolution lines 26T. Failing this, it is necessary that they at least are kept out of the shaded areas 28T.

Thus, while a candidate optimum cycle length has been selected as being 54 seconds for the traffic control situation presented above, other candidate optimum cycle lengths may also be derived by repositioning the overlay element 20 in a left/right direction. It is not uncommon for a particular configuration of controlled intersections to have more than one near optimum cycle length applicable to them. However, it should be noted that between candidate optimum cycle lengths, (say for example, a first candidate at 54 seconds, and another candidate at 79 seconds) intermediate cycle lengths between 54 and 79 seconds may be chosen which are entirely inappropriate for the expeditious movement of traffic through the controlled artery.

While only certain preferred features of the instant invention have been shown by way of an illustrative embodiment, of the computational aid, and an illustrative example showing the method of use, many modifications and changes will occur to those skilled in the art. It is therefore to be understood that the appended claims are intended to cover all such modifications and changes as fall within the true spirit and scope of the invention.

What is claimed is:

1. A computational device for determining optimum average cycle lengths for an arterial traffic control system, which comprises:

(a) a base member;

(b) a transparent overlay member;

said base member having indicia representative of a portion of a speed scale arrayed along a first axis, and indicia representative of a portion of a travel time scale arrayed along a second axis, said base member having a plurality of spaced, constant speed lines emanating from said first axis and disposed parallel to said second axis, whereby a first grid representative of speed versus travel time is obtained;

said overlay member having indicia representative of average cycle lengths in units of time and forming a portion of a time scale arrayed along a first axis, and indicia representative of cycle resolution centerpoints arrayed along a second axis, said overlay member having a plurality of lines extending ray-like from said centerpoints, pairs of adjacent ray-like lines defining first and second acceptable cycle length zones therebetween and an unacceptable cycle length zone positioned between said first and second acceptable cycle length zones, each zone extending ray-like between each pair of adjacent ray-like lines, whereby a second grid representative of average cycle length versus cycle resolution centerpoints is obtained; and (c) said first and second grids having predetermined scale factor relationships which cooperate as the overlay member is shiftably aligned with the base member so as to produce an overlapping display of points plotted on constant speed lines of said base member with acceptable cycle length zones of said overlay member.

2. The computational device of claim 1 wherein:

(a) said base member first and second axes are mutually orthogonal, and said speed scale is graduated in miles per hour, and said travel time scale is graduated in seconds;

(b) said overlay member first axis and said overlay member cycle resolution centerpoints are graduated in seconds; and (c) said first axes of the base member and said first axis of said overlay member are maintained in parallel relationship during said shiftable alignment.

3. The computational device of claim 2 wherein said overlay member is substantially transparent and said composite display comprises the superposition of the indicia on said base and overlay members.

4. The computational device of claim 2 wherein said base member is in the form of a flat, rectangular sheet and said speed scale and travel time scale indicia are located on a flat surface thereof, and said overlay member is in the form of a flat, rectangular, transparent sheet and said time scale and cycle resolution centerpoint indicia are located on a flat surface thereof, and human readable markings placed on said base member are viewable through said overlay member when said surfaces are placed in abutting planar relationships.

5. A method for determining an average cycle length in an arterial traffic control system having a plurality of controlled intersections distributed along a traffic artery, comprising the steps of:

(a) determining the separations of the controlled intersections along said artery in units of travel time at a given speed desired for traffic flow;

(b) plotting said separations along a travel time axis of a travel time/speed grid at a position on a speed axis corresponding to the given speed;

(c) forming a transparent overlay member having indicia representative of average cycle lengths in units of time arrayed along a first axis and indicia representative of cycle resolution centerpoints arrayed along a second axis, forming lines on said overlay member emanating in ray-like fashion from said centerpoints, and forming at least two cycle length zones between each adjacent pair of lines, said zones extending ray-like between said pairs of lines;

(d) placing said overlay member over said travel time/speed grid with said first axis of said overlay member overlapping said speed axis of said grid;

(e) shifting said overlay member relative to said grid while maintaining said first axis of said overlay member in overlapping relationship with said speed axis of said grid;

(f) continually shifting said overlay member relative to said grid as in step e) until said plotted separations fall within corresponding cycle length zones of said overlay member; and (g) reading an average cycle length value from said first axis of said overlay member.

* * * * *